United States Patent [19]

Jacobs

[11] 4,253,042

[45] Feb. 24, 1981

[54] ALTERNATING CURRENT LAMPCHANGER CONTROL CIRCUIT

[75] Inventor: Thomas A. Jacobs, Cypress, Tex.

[73] Assignee: Tideland Signal Corporation, Houston, Tex.

[21] Appl. No.: 61,967

[22] Filed: Jul. 30, 1979

[51] Int. Cl.[3] ..... H05B 37/04

[52] U.S. Cl. ..... 315/89; 340/642

[58] Field of Search ..... 315/89, 90, 200 A, 313; 362/20, 254; 307/39; 340/642

[56] References Cited

U.S. PATENT DOCUMENTS

| | | | |
|---|---|---|---|
| 3,855,586 | 12/1974 | Jacobs | 315/89 |
| 3,855,587 | 12/1974 | Jacobs | 315/89 |
| 3,964,040 | 6/1976 | Behl | 315/89 |

*Primary Examiner*—Eugene R. LaRoche

*Attorney, Agent, or Firm*—Fulbright & Jaworski

[57] ABSTRACT

An alternating current lampchanger control circuit for driving a rotatable turret having a plurality of lamps, such as used in a navigational light. An input receives pulsed alternating current signals and is connected to a power circuit including fixed contacts for supplying the pulsed signals to one of the lamps in the turret. A lamp-out sensing circuit includes a transformer which has a primary in the lamp power circuit and has a rectifier connected to the transformer secondary. Switching means are connected to the rectifier and are actuated to an on position by a lamp failure. An alternating current turret motor is connected to the input or to a continuous source of alternating electrical current through the switching means for rotating the turret upon a lamp failure. The switching means may include a first triac controlling a second triac connected to the motor. Third switching means are included in a feedback loop to provide an alternating current drive for the motor in a continuous mode. A capacitor is connected to and actuated by a current flow to the motor with a fourth switch connected between the capacitor and the first switch which is actuated when a new lamp is rotated into position whereby the charged capacitor turns the power to the motor off. A fifth switch is connected in the motor circuit to stop the motor when all the lamps burn out. A test switch is connected between the lamp-out sensing circuit and ground causing the motor to run for testing. A peak suppression circuit prevents unwanted actuation of the switches.

12 Claims, 1 Drawing Figure

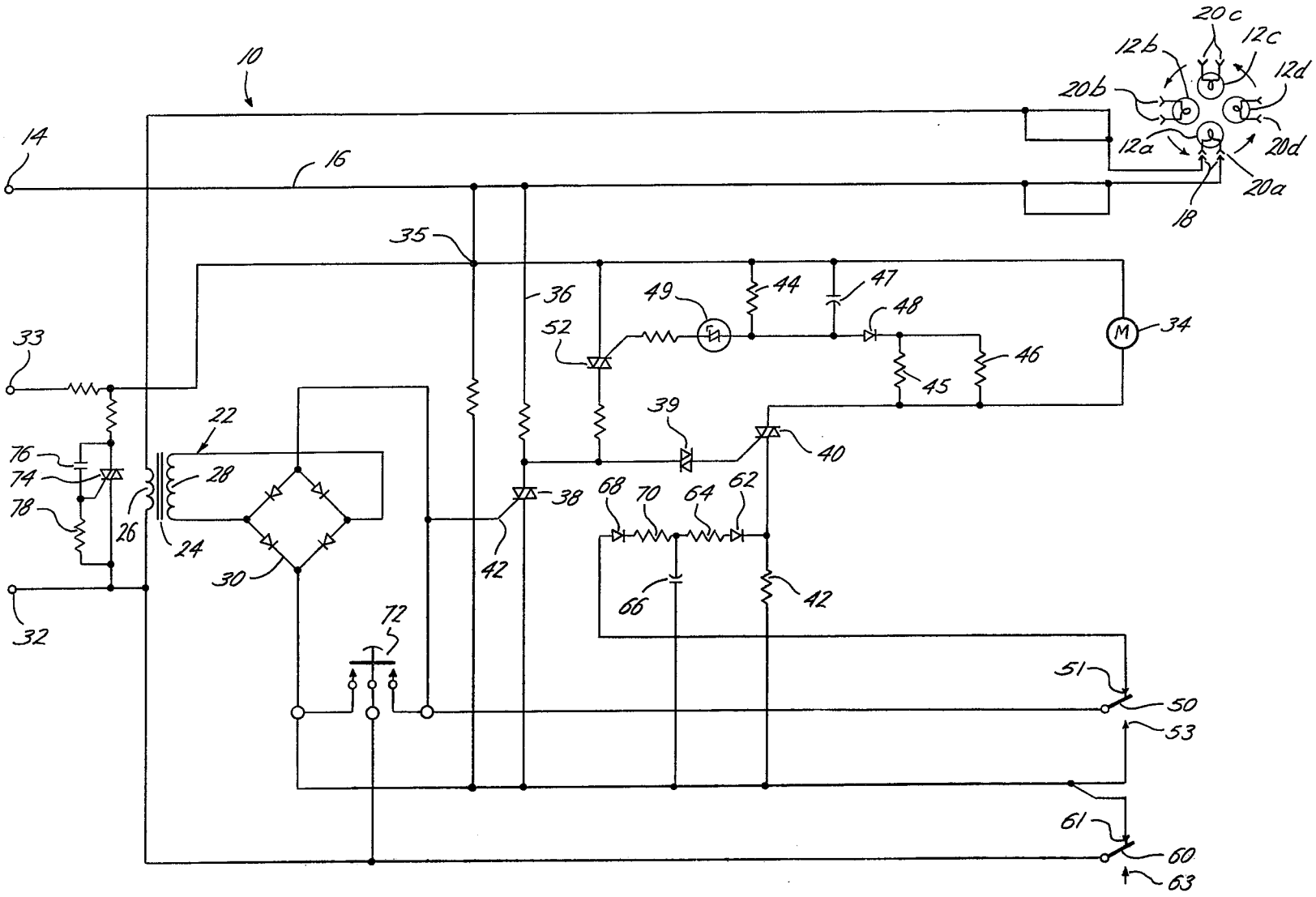
10
12a
12b
12c
12d
14
16
18
20a
20b
20c
20d
22
24
26
28
30
32
33
34
35
36
38
39
40
42
44
45
46
47
48
49
50
51
52
53
60
61
62
63
64
66
68
70
72
74
76
78

ALTERNATING CURRENT LAMPCHANGER CONTROL CIRCUIT

BACKGROUND OF THE INVENTION

It is old, as shown in U.S. Pat. No. 3,855,587, to utilize a battery to power a lamp changer control circuit for rotating a turret having a plurality of lamps when one of the lamps burns out to place a new lamp in an operating position, such as in a navigational light.

In installations where alternating current is available, it is desirable to use an alternating current power source for powering a lampchanger control circuit thereby overcoming the problem of the short life of a battery powered supply. However, in utilizing an alternating power source which provides pulsed signals to flash a lamp, various problems in recognition and actuation are encountered since the pulsed signal may be as short as 0.3 seconds. In addition ac power peaks adversely affect circuit operations.

The present invention is directed to various improvements in an alternating current lampchanger control circuit which receives pulsed alternating current signals for lighting one of the lamps in a rotatable turret and includes an alternating current motor for rotating the turret when a lamp burns out to place a new lamp in position.

SUMMARY

The present invention is directed to an alternating current lampchanger control circuit which receives pulses of alternating current signals from a separate flasher for lighting one of a plurality of lamps in a rotatable turret. When the operating lamp burns out, the circuit actuates an alternating current motor to rotate the turret to place a new lamp in the operating position.

One feature of the present invention is the provision of an alternating current lampchanger control circuit in which the circuit may have a first pulsed mode in which the motor is actuated by the signal pulses and thus rotates between lamp positions only when power signals are applied to the lamp, and a second mode in which a continuous alternating current is applied to the motor to rotate the motor in a continuous movement between lamp positions.

Another feature of the present invention is the provision of a lampout sensing circuit connected to a lamp power circuit for measuring the flow of current through the power circuit and determining when a lamp is burned out. The sensing circuit includes a transformer having a primary which is connected in the lamp power circuit and a rectifier is connected to the secondary of the transformer for converting the current passing through the lamp to a direct current. A direct current switching means is connected to the rectifier and detects lamp failures. The lampout sensing circuit provides a long life circuit which avoids the use of mechanical relays and allows the alternating current pulses to be sensed by direct current sensing hardware.

Another feature of the present invention is the use of an alternating current turret motor connected to either the alternating current signal input or a continuous source of alternating current through the switching means for rotating the turret in response to the actuation of the switching means upon a lamp failure. The switching means may include a first switching means such as a triac connected to and controlled by the output from the rectifier and a second triac connected to the first triac and to the input signal and controlled by the first triac and in turn controlling the application of alternating current to the motor.

Still a further feature of the present invention is the provision of a feedback loop including a third switching means to provide a continuous alternating current drive for operating the motor in a continuous drive mode. The feedback loop may include a time delay circuit to insure that the feedback loop is not activated by random noise spikes.

Yet a further object of the present invention is the provision of a circuit to run the turret motor in a continuous mode and yet have it stop at the proper place. Such a circuit may include a capacitor connected to and actuated by current flow through the motor with a fourth switch connected between a capacitor and the first switch in which the fourth switch is actuated when a new lamp is rotated into position with the power contacts whereby the charged capacitor switches the first and second switches to turn the power off to the motor.

Still a further object of the present invention is the provision of a fifth switch connected in the motor circuit and actuated when all of the lamps have been rotated out of contact with the power contacts for stopping further actuation of the motor.

Yet a still further object of the present invention is the provision of a test switch connected between the lampout sensing circuit and ground for causing the motor to run when the test switch is actuated.

Yet a further object is a peak voltage suppression circuit connected to the control circuit for preventing undesired actuation of the circuit by voltage peaks.

Other and further objects, features and advantages will be apparent from the following description of a presently preferred embodiment of the invention, given for the purpose of disclosure, and taken in conjunction with the accompanying drawings.

BRIEF DESCRIPTION OF THE DRAWINGS

The FIGURE is an electrical and mechanical schematic of the alternating circuit lampchanger control circuit of the present invention.

DESCRIPTION OF THE PREFERRED EMBODIMENT

Referring now to the drawing, the reference numeral 10 generally indicates the lampchanger control circuit of the present invention for driving a rotatable turret having a plurality of lamps **12*a*, 12*b*, 12*c* and 12*d*, one of which, lamp 12*a***, is in the operating position. While any suitable type of turret may be used, the preferred turret may be one shown in co-pending patent application entitled "Position Sensor for Rotatable Lampchanger Turret", Ser. No. 930,308, filed Aug. 2, 1978, now U.S. Pat. No. 4,190,777, issued Feb. 26, 1980, and co-pending patent application entitled "A Lampchanger for a Light", Ser. No. 929,397, filed July 31, 1978, which are owned by the assignee of the present application and which are incorporated herein by reference.

The purpose of the present invention is to, when one of the lamps such as **12*a* burns out, rotate another lamp, such as lamp 12*b***, into the operating position.

The control circuit 10 includes input 14 for receiving pulsed alternating current signals from any suitable separate flasher, which is conventional and no further description is necessary. The pulsed signals at the input 14 are for the purpose of flashing the operating lamp, such as lamp 12*a*, as desired, such as coded on and off signals. The coded signals may be of any desired length, but may be as short as 0.3 seconds. A lamp power circuit generally indicated by the reference numeral 16 is connected from the input 14 to fixed contacts 18 which engage movable contacts 20*a*–20*b* of the lamps 12*a*–12*d*, respectively, when the lamp is in the operating position.

A lampout sensing circuit generally indicated by the reference numeral 22 is provided for sensing when the lamp in the operating position, such as lamp 12*a*, is burned out, and for actuating the turret to rotate a new lamp, such as 12*b*, into the operating position. The sensing circuit 22 includes a transformer 24 having a primary 26 and a secondary 28 with the primary 26 connected in the power circuit 16. The transformer may be of the Type NT3582 manufactured by National Transformer Company. Rectifier means, such as a Wheatstone bridge circuit 30, is provided for converting the pulsed alternating current passing through a lamp to a direct current. The direct current is used to provide a signal to switching means for actuating an alternating current turrent motor 34, which may be a conventional 120 volt, 3 rpm motor, for rotating a turret. The use of a lampout sensing circuit 22 utilizing the transformer 24 to convert an alternating current signal to a direct current signal for actuating a solid state switching circuit provides several advantages. First, the sensing circuit 22 provides a minimum voltage drop so as not to unduly affect the voltage to the operating lamp 12*a* and performs its function without mechanical switching which increases the life of the circuit. Prior art circuits generally use relays or solenoids with the coils in series with the lamp load which cause excessive voltage drop and in addition use large gauge wire causing package problems, and includes mechanical parts which were subject to failure.

The circuit 10 also includes a neutral terminal 32 and a power terminal 33 for supplying power to actuate the motor 34. In one embodiment the terminal 33 is connected directly to the terminal 14, such as by connection 35, for actuating the motor 34, when a lamp is burned out, by the pulsed alternating current signals applied to terminal 14. In this case, the pulsed alternating current signals are applied through line 36 to the switching means, which may include a first switching means such as triac 38, and a second switching means such as traic 40 through conventional diac 39. However, so long as the lamp in the operating position, such as lamp 12*a*, is good, the incoming pulsed alternating current signals applied to line 36 will be applied to the triac 38 simultaneously with a dc signal applied to the line 42 to the gate of triac 38 which actuates triac 38 and connects it to neutral. Therefore the application of the pulsed signal on line 36 to the gate of triac 40 is basically shorted to neutral and the gate of triac 40 therefore does not have a sufficient signal to actuate the triac 40 and in this event the motor 34 is not turned on.

On the other hand, in the event that the filament of the operating lamp such as 12*a* burns out, the pulsed alternating current signal to the input 14, while continuing to the line 36, does not flow through the lamp sensing circuit 22 and there is no direct current on line 42 and therefore the first switching means 38 does not receive a turn on signal and the pulsed alternating current signal on line 36 is applied to the gate of the second switching means 40 which turns the triac 40 on. With triac 40 turned on, there is a completed path for the motor circuit through the triac 40 and resistor to the neutral terminal 32. In this operating mode, the motor 34 will receive the pulsed alternating current signal (since terminal 33 is connected to terminal 14) and the motor will rotate the turret in response to the pulsed signals until a new lamp, such as lamp 12*b* is rotated into the operating position at which time the lamp sensing circuit 22 will again sense current through the filament of lamp 12*b* and turn off the power to the motor 34.

However, in the pulsing mode, the motor 34 runs between lamp positions only in response to the pulsed alternating current signals which are applied to a lamp and in such event the time for rotating a new lamp into position may not meet the Coast Guard specifications which require a lamp to be changed within six seconds. Therefore, the preferred embodiment is to provide a continuous alternating current power source connected to input terminal 33 (and connection 35 is omitted) to provide a continuous mode of operation in which the motor 34 runs steadily between lamp positions.

In the continuous mode of operation, a continuous alternating current power is supplied to the terminal 33 and the pulsed alternating current signal is applied to terminal 14. In the continuous mode of operation, the motor 34 is activated as before, that is, as long as the sensing circuit 22 senses current through the lamp in the operating position, the triac 38 is activated simultaneously with the application of the pulsed signals on line 36 to prevent the triac 40 from being turned on. However, when the lamp filament burns out, the triac 38 is no longer turned on and the pulsed signals on line 36 turns on triac 40 to actuate the motor 34. However, the triac 40 is only turned on so long as a signal is applied to line 36. Therefore, a feedback loop is provided which includes a third switching means, such as triac 52 between the continuous power source on terminal 33 and ground to keep the motor 34 operating continuously. That is, the feedback loop includes resistors 44, 45 and 46 which, when the motor is initially actuated by triac 40, provide a voltage to the gate of triac 52 to turn triac 52 on to provide a continuous electrical source between the terminal 33 and triac 40 thereby keeping triac 40 on even when the incoming lamp signal on line 36 is off. The motor 34 is then running with a continuous voltage applied and it can more quickly insert a new lamp in place. Triacs 38, 40, 52 and 54 may be type L 4003 manufactured by Teccor Company. Preferably, the feedback loop also includes time delay means to insure that the feedback loop is not actuated by random noise spikes. Therefore, the feedback loop includes a capacitor 47, diode 48 and a bilateral switch 49 such as type ST4 manufactured by General Electric. While the feedback loop creates a voltage across capacitor 47 which fires switch 49 to activate triac 52, stray voltage peaks are prevented by the switch 49 from reaching and turning triac 52 on.

However, continuous rotation of the motor 34 which is now operating free of the pulsed signals on line 14 may cause the next lamp such as lamp 12*b* to be rotated past the operating position of the fixed contacts 18 in the event that there is not a pulsed signal applied to terminal 14 at the moment that a new lamp is rotated against the contacts 18. Furthermore, it is not desirable to keep rotating the turret when all of the lamps 12*a*–12*d* have burned out, regardless of the mode of operation. Therefore, mechanically actuated switches 50 and 60 are provided which may be cam operated switches which are mechanically actuated in accordance to the rotative position of the turret as more fully described in co-pending patent application Ser. No. 930,308 described above. Switch 50 is moved to position 51 when a lamp is moved into position against contacts 18 and is moved to contact 53 when a lamp is moved out of engagement with the contact 18. Switch 60, in series with motor 34, is normally in engagement with contact 61, but after all of the lamps 12*a*–12*d* have been rotated past the fixed contacts 18, the switch 60 is moved away from contact 61 to contact 63 to stop motor 34.

With the motor 34 running and a lamp moved away from the contacts 18, the switch 50 is in engagement with contact 53 and a portion of the motor current passes through a circut including diode 62, and resistor 64 to charge capacitor 66. When a new lamp, such as 12*b*, is rotated into proper flashing position, in engagement with the fixed contacts 18, switch 50 is actuated and moves into engagement with contact 51. With actuation of switch 50, the capacitor 66 discharges through diode 68, resistor 70 and switch 60 to the gate of triac 38 and turns on triac 38 thereby shorting out the motor drive signal which has been applied to the gate of triac 40 and stops the motor 34 regardless of whether or not a pulsed signal appears at terminal 14 when the new lamp 12*b* engages the contacts 18.

In addition, if desired, a test switch 72 may be provided which is connected between the lampout sensing circuit 22 and neutral whereby an operator may activate the switch 72 to insure that a lamp changing circuit 10 is properly operated.

As a further aid to prevent undesired admission of voltage peaks out of circuit 10, a voltage suppression circuit may be connected between input 33 and neutral 32. The circuit includes triac 74, capacitor 76 and resistor 78. An undesirable voltage peak on input 33 will charge capacitor 76 to apply a signal to the gate of triac 74 which will turn triac 74 on and reduce the high peaks, due to the voltage divider, to neutral 32.

The present invention, therefore, is well adapted to carry out the objects and attain the ends and advantages as well as others inherent therein. While a presently preferred embodiment of the invention is given for the purpose of disclosure, numerous changes in the details of construction and arrangement of parts will readily suggest themselves to those skilled in the art and which are encompassed within the spirit of the invention and the scope of the appended claims.

What is claimed is:

1. A lampchanger control circuit for driving a rotatable turret having a plurality of lamps comprising, a signal input for receiving pulsed alternating current signals, a lamp power circuit connected to the signal input and including power contacts for supplying power to one of the lamps in the turret, a lampout sensing circuit including a transformer having a primary and secondary with the primary connected in said lamp power circuit, rectifier means connected to the secondary for converting current passing through a lamp to direct current, and direct current switching controlled means connected to the rectifier means and controlled by a lamp failure, and an alternating current turret motor adapted to be connected to an alternating current source through the switching means for rotating the turret in response to actuation of the switching means upon a lamp failure.

2. The apparatus of claim 1 wherein the turret motor is connected to the signal input.

3. The apparatus of claim 1 wherein the turret motor is connected to a source of continuous alternating current for rapidly rotating the turret.

4. The apparatus of claim 1 wherein the direct current controlled switching means includes a first triac connected to and controlled by the output from the rectifier, and a second triac connected to and controlled by the first triac and controlling the application of alternating current to the motor.

5. A lampchanger control circuit for driving a rotatable turret having a plurality of lamps comprising, a signal input for receiving pulsed alternating current signals, a lamp power circuit connected to the signal input and including power contacts for supplying power to one of the lamps in the turret, a lampout sensing circuit including a transformer having a primary and secondary with the primary connected to said lamp power circuit, rectifier means connected to the secondary for converting current passing through a lamp to direct current, and direct current controlled switching means including a first triac connected to and controlled by the output from the rectifier and a second triac connected to the first triac and to the signal input and controlled by the first triac, and an alternating current turret motor connected to the signal input through the second triac for rotating the turret in response to the actuation of the direct current switching means upon a lamp failure.

6. A lampchanger control circuit for driving a rotatable turret having a plurality of lamps comprising, a first input for receiving pulsed alternating current signals, a second input for receiving continuous alternating current, a lamp power circuit connected to the first input and including power contacts for supplying power to one of the lamps in the turret, a lampout sensing circuit including a transformer having a primary and secondary with the primary connected in said lamp power circuit, rectifier means connected to the secondary for converting current passing through a lamp to direct current, a direct current controlled switching means connected to the rectifier means and actuated by a lamp failure, a second switching means connected to the direct current switching means and the first input and actuated by the direct current switching means, an alternating current turret motor connected to the second input through the second switching means for rotating the turret in response to a lamp failure, a feedback circuit including, third switching means connected to and actuated by current flow through the motor and connected to the second input to supply continuous alternating current between the second input and the second switching means for continuously actuating the motor.

7. The apparatus of claim 6 including, a capacitor connected to and actuated by current flow through the motor, a fourth switch connected between the capacitor and the first switching means, said fourth switch actuated when a new lamp is rotated into position with the power contacts whereby the charged capacitor switches the first and second switches to turn the power off to the motor.

8. The apparatus of claim 7 including, a fifth switch connected in the motor circuit and actuated when all of the lamps have been rotated out of contact with the power contacts for stopping further actuation of the motor.

9. The apparatus of claim 6 including, a test switch connected between the lampout sensing circuit and ground for causing the motor to run when the test switch is actuated to the closed position.

10. The apparatus of claim 6 wherein the direct current switching means, second, and third switching means are triacs.

11. The apparatus of claim 6 wherein the feedback circuit includes a bilateral switch connected to the third switching means for preventing actuation of the third switching means by random noise spikes and a capacitor connected to the bilateral switch for turning the switch on.

12. The apparatus of claim 6 including a voltage peak suppression circuit connected to the second input including a sixth switch and an RC circuit for actuating the sixth switch by predetermined voltage peaks on the second input.

* * * * *